United States Patent [19]

Huemer

[11] Patent Number: 4,658,862

[45] Date of Patent: Apr. 21, 1987

[54] DRIVING ARRANGEMENT FOR A CIRCULAR LOOM

[76] Inventor: Franz X. Huemer, Sonnenuhrgasse 4, 1060 Vienna, Austria

[21] Appl. No.: 736,784

[22] Filed: May 22, 1985

[30] Foreign Application Priority Data

Jun. 8, 1984 [CH] Switzerland ..... 2797/84

[51] Int. Cl.[4] ..... D03D 37/00; D03D 51/00

[52] U.S. Cl. ..... 139/13 R; 139/1 E

[58] Field of Search ..... 139/13 R, 16, 1 E, 304, 139/370.1

[56] References Cited

U.S. PATENT DOCUMENTS

| | | | |
|---|---|---|---|
| 2,893,439 | 7/1959 | Rabeux | 139/13 R |
| 3,220,438 | 11/1965 | Malchair | 139/13 R |
| 3,612,109 | 10/1971 | Pfarrwaller | 139/304 |
| 4,398,568 | 8/1983 | Rydborn | 139/1 E |

FOREIGN PATENT DOCUMENTS

| | | | |
|---|---|---|---|
| 2935507 | 3/1981 | Fed. Rep. of Germany | 139/1 E |
| 2063934 | 11/1979 | United Kingdom | 139/13 R |
| 2079333 | 7/1980 | United Kingdom | 139/13 R |

*Primary Examiner*—Henry S. Jaudon
*Assistant Examiner*—Joseph S. Machuga
*Attorney, Agent, or Firm*—Karl F. Ross; Herbert Dubno

[57] ABSTRACT

A driving arrangement for a circular loom has at least one electromagnetic coupling which is capable of being actuated by a stop impulse synchronous with the stop signal of the weft thread supervisor, is disposed between the driving motor of the circular loom and the transmission of the fabric drawing-off device. This permits at a stop signal from the weft thread supervisor the disengagement of the transmission of the fabric drawing-off device from the driving motor of the circular loom, whereupon the fabric drawing-off device, with the inertia of the main shaft, immediately stops, unaffected by after-running of other loom components connected to the motor.

2 Claims, 2 Drawing Figures

DRIVING ARRANGEMENT FOR A CIRCULAR LOOM

FIELD OF THE INVENTION

The present invention relates to a driving arrangement for a circular loom having a plurality of partial heald shafts arranged radially round a main reed of the loom, and each having a plurality of inner and outer healds for the guidance of a part of the two systems of warp yarn distributed all around, which, for the formation of the weaving a travelling shed, are given by way of a rotating main shaft a countercurrent up-and-down alternating motion. The main shaft drives rotatingly the weaving shuttles in the circular reed by means of a plate cam, and the thus formed tubular a fabric is drawn off by fabric drawing-off mechanism, the drive of which is effected by the motor on the main shaft, which is capable of being switched off by its electric circuit with a signal resulting from weft thread supervising means.

BACKGROUND OF THE INVENTION

Hitherto known circular looms comprise a plurality of partial heald shafts, which are arranged radially around the circular reed of the loom, and each has a plurality of inner and outer healds for the guidance of a part of the two systems of warp yarn distributed all around, which, for the formation of the weaving or travelling shed, are given by way of the main shaft a countercurrent up-and-down alternating motion. The weaving shuttles, circulated in the circular reed by the main shaft, carry the weft thread being unwound from the respective bobbin, continually into the travelling shed. The tubular fabric thus manufactured is then drawn off and collected as a flat tubular fabric.

A serious disadvantage of such circular looms is that thin places can be found in the fabric after a weft thread fault, for instance, owing to the depletion of the weft thread package of one or the other of the shuttles, or as a result of weft thread breakage. It is true that the usual weft thread supervising means on the reed of the loom are in a position to immediately transmit a stop signal in the case of a detected weft thread fault to the main shaft of the circular loom on one hand, and to the motor driving the fabric drawing-off device on the other hand, which, however, do not come to a standstill abruptly, but continue to turn under the effect of the considerable inertia of the main shaft. This results in a further drawing-off of the fabric, whereby, on recirculation of the shuttles, less weft threads per warp thread unit of length are woven in, since at least one weft thread is missing. As a rule, the shuttles can make another two to three revolutions after a loom stop signal until the loom comes to a complete standstill.

OBJECT OF THE INVENTION

It is therefore the object of the present invention to so improve the driving arrangement of such a circular loom in such a manner that previously unavoidable thin parts in the fabric, owing to after-running of the stopped loom, are avoided.

SUMMARY OF THE INVENTION

This is achieved according to the invention first of all in that at least one electromagnetic coupling, which is capable of being actuated by a stop impulse synchronous with the stop signal of the weft thread supervising means, is disposed between the driving motor of the circular loom and the transmission means of the fabric drawing-off device.

Due to these measures, it is henceforth possible at a stop signal from the weft thread supervising means to disengage the transmission means of the fabric drawing-off device from the driving motor of the circular loom, whereupon the fabric drawing-off device, devoid of mass and the resulting inertia, immediately stops, unaffected by after-running of other loom components connected to the motor.

Due to the immediate stopping of the fabric drawing-off device while the after-running of the weaving shuttles continues, more weft yarn is inserted during the passage to standstill, so that a thread concentration results; this, however, is not considered disadvantageous compared with a previous thin part, which greatly reduced the strength of the fabric.

In order to guarantee an absolutely safe, immediate stopping of the fabric drawing-off device, the driving arrangement according to invention can be further constructed such that an electromagnetic brake, which is capable of being actuated by a stop impulse synchronous with the stop signal of the weft thread supervising means, is provided in addition to the coupling.

Furthermore, the driving arrangement according to invention permits intentional formation of said weft thread concentrations, forming horizontal stripes, in a simple way periodically and with given spacing. At such stripes separation of the width of fabric may be carried out, with the weft thread concentrations forming, for instance, in the manufacture of sacks, reinforcements for the top edge of the sack as well as for the sack bottom.

This can be accomplished in a very simple manner by having the electromagnetic coupling and, should the occasion arise, the brake, actuated by a stutter switching independent of the stop impulse of the weft thread supervising means.

BRIEF DESCRIPTION OF THE DRAWING

The invention is described in more detail with reference to the following drawing, wherein.

SPECIFIC DESCRIPTION

Figure 1:
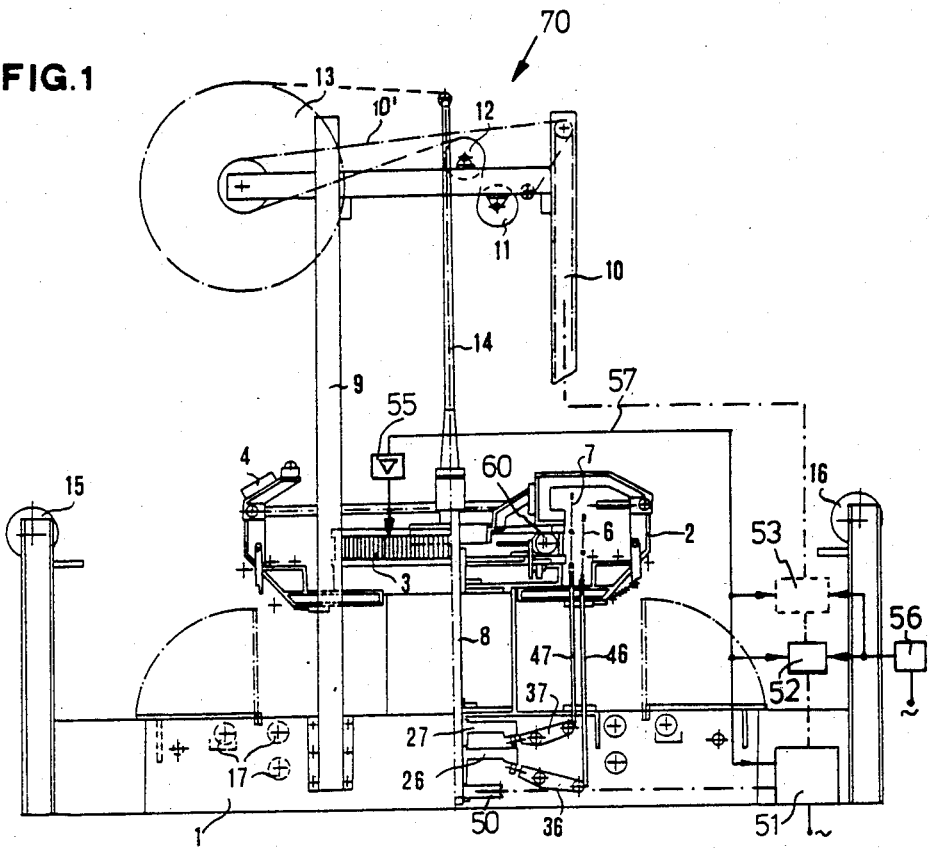
FIG. 1 is a schematic representation in side view of a circular loom with the driving arrangement in accordance with the invention.
Figure 2:
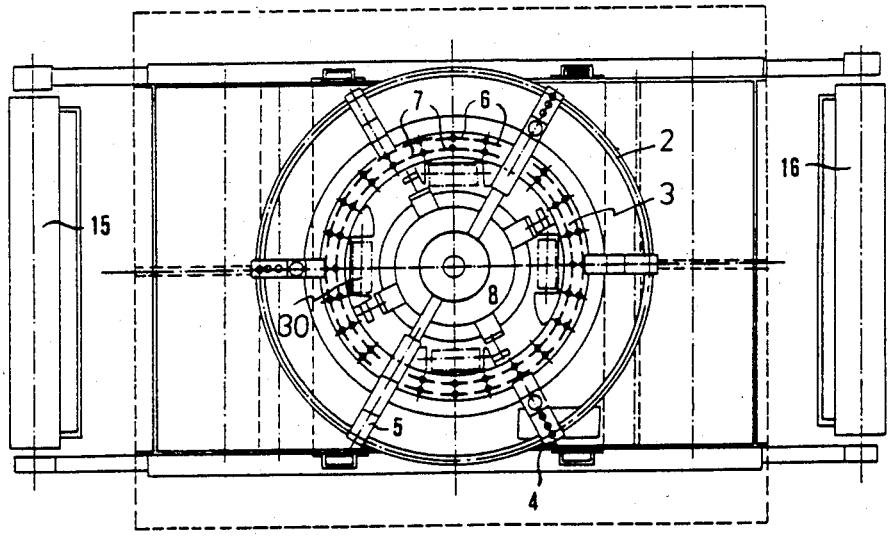
FIG. 2 is a plan view of the circular loom shown in FIG. 1.

The circular loom diagrammatically seen in FIGS. 1 and 2 is mounted in the conventional way on a loom base 1, and comprises a circular frame carrier 2, which carries a circular reed 3, a stop-start unit 4 for the loom, frame members 5, a ringholder and among other things also partial heald shafts 6 and 7. These partial heald shafts 6 and 7 are arranged here radially around the main shaft 8 of the loom, with these forming outer partial heald shafts 6 and inner partial heald shafts 7.

In addition, the support 9 for the textile drawing-off device 70 is mounted on the loom base 1, which among other things supports a transmission means 10 for the fabric removal with the expander rollers 11 and 12 for the belt drive 10′ of the bale of fabric 13. A fabric expander 14 is also disposed in the drawing-off area.

Further, in the circular loom illustrated, it is also possible to see a feed roller 15 for the warp threads or narrow warp layers on the left-hand side and a feed roller 16 for the warp threads on the right-hand side, and, moreover, overflow rollers 17 for these narrow warp layers. These warp threads or narrow warp layers are distributed in two radially-arranged warp yarn sheets and are drawn off in a generally known manner by groups of warp thread bobbins (not shown). For the formation of the weaving shed by the partial heald shafts, one of these thread gather is lifted up while the other is guided down from the level of the weaving plane by the shedding motion, so that a warp thread upper shed and a warp thread lower shed result. In this weaving or travelling shed, at least one, as a rule several shuttles 30 each with a bobbin of weft yarn can be passed along a horizontal circular path through the sheds. Owing to the circular motion of the shuttles, the pick wound off from the bobbin of weft yarn is transferred onto the edge of the tubular fabric so that this bobbin thread can be woven into the fabric. The tubular fabric can then be drawn off and collected as a flat tubular fabric.

The drive of the shuttles 30 is effected by a plate cam 33, which is mounted rotatably on the main shaft 8 of the loom, and which engages with pushing means in trust on the shuttles. The main shaft 8 is connected by transmission means 50 to a driving motor 51. As a rule, this motor 51 is also connectd to the drive 10 of the fabric draw-off device 70.

Further, the main shaft 8 carries here two further plate cams 26 and 27 which are operatively connected to so-called shaft rods 46 and 47 by a plurality of rocking levers 36 and 37 radially disposed about the plate cam. The shaft rods 46 and 47 transmit in known manner the shedding motion to the partial heald shafts 6 and 7.

To the extent described above, the construction of the circular loom corresponds to the known prior art, so that further explanation of such a loom is unnecessary.

To prevent the development of thin parts in a fabric after a stop signal has been generated by a weft thread fault, an electromagnetic coupling 52 and preferably also an electromagnetic brake 53 are disposed between the driving motor 51, which is, in known manner, connected in circuit with a weft thread supervising means 55 (not shown here in detail) and switched off from its electric circuit by a signal, in the case of a weft thread fault, and the transmission means 10 of the fabric drawing-off device 70. This electromagnetic coupling 52 as well as the brake 53 are capable of being actuated by a stop impulse synchronous with the stop signal of the weft thread supervising means 55. According to FIG. 1, the coupling 52 and the brake 53 are connected directly to the weft thread supervising means 55 by way of the control wire 57.

At a stop signal of the weft thread supervising means 55, resulting from a weft thread fault, not only is the motor 51 is switched off but, in addition, the transmission means 10 of the fabric draw-off device 70 is simultaneously disengaged from the driving motor 51 of the circular loom, whereupon the fabric drawing-off device, devoid of mass, immediately stops, unaffected by after-running of other loom components connected to the motor.

Due to the immediate stopping of the fabric drawing-off device 70 on the one hand, and on the other hand due to the after-running of the weaving shuttles 30 in the shed, more yarn is, then, worked into the fabric after the stop signal until complete standstill, so that a thread concentration in the fabric results.

This effect can as it now is to be utilized in order that weft thread concentrations, forming horizontal stripes, may be effected in a simple way periodically and with given spacing, at which place a separation of the width of fabric may be carried out, with the weft thread concentrations forming, for instance, in the manufacture of sacks, reinforcements for the top edge of the sack as well as for the sack bottom.

In order to achieve this, the electromagnetic coupling 52 and, if desired, the brake 53 are, according to FIG. 1, capable of being actuated by a stutter switching unit 56 or the like independent of the stop impulse of the weft thread supervising means 55.

Such stutter switching units or the like are generally known preprogrammable arrangements for generating periodic or aperiodic electric switching pulses, and need not therefore, generally be explained in detail here. Likewise, generally-known devices are usable as electromagnetic couplings and brakes.

While there are shown and described present preferred embodiments of the invention, it is to be distinctly understood that the invention is not limited thereto, but may be otherwise variously embodied and practiced within the scope of the following claims.

What I claim is:

1. In a circular loom comprising:

a main drive shaft;

an electric motor operatively connected to said main drive shaft for rotating same;

means connected to said main drive shaft for establishing a circularly traveling shed;

a circular reed cooperating with said shed to generate a tubular fabric;

a circulating shuttles operatively connected to said main drive shaft for depositing weft thread in said shed in the generation of said fabric;

weft thread supervising means monitoring said weft thread and upon the development of a fault therein generating a stop impulse for deenergizing said motor;

a fabric drawing-off mechanism receiving the generated fabric and collecting same in a flattened form; and a transmission operatively connecting said fabric drawing-off mechanism with said motor, the improvement which comprises the combination therewith of:

an electromagnetic coupling between said transmission and said motor and connected with said weft thread supervising means for synchronously with the generation of said stop impulse mechanically deenergizing said transmission from said motor; and an electromagnetic brake operatively connected to said transmission and actuated by an impulse synchronous with said stop impulse for immediately upon the generation thereof bringing said fabric drawing-off mechanism to standstill while, with said motor deenergized, said traveling shed continues to form and said shuttles to circulate under inertia of said shaft and parts connected therewith.

2. The improvement defined in claim 1 wherein said electromagnetic coupling and said brake are also provided with programmable switch means for generating pulses actuating said coupling and said brake independently of said stop impulse for producing weft-accumulation strips in said fabric at selected locations.

* * * * *